US009074277B2

(12) United States Patent
Maki et al.

(10) Patent No.: US 9,074,277 B2
(45) Date of Patent: Jul. 7, 2015

(54) PLATED STEEL SHEET AND METHOD OF HOT-STAMPING PLATED STEEL SHEET

(75) Inventors: Jun Maki, Tokyo (JP); Masao Kurosaki, Tokyo (JP); Seiji Sugiyama, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 873 days.

(21) Appl. No.: 13/309,143

(22) Filed: Dec. 1, 2011

(65) Prior Publication Data

US 2012/0073351 A1 Mar. 29, 2012

Related U.S. Application Data

(62) Division of application No. 12/736,462, filed as application No. PCT/JP2009/058227 on Apr. 21, 2009, now Pat. No. 8,453,482.

(30) Foreign Application Priority Data

Apr. 22, 2008 (JP) ..... 2008-111753

(51) Int. Cl.

| | |
|---|---|
| ***C23C 2/12*** | (2006.01) |
| ***B21D 35/00*** | (2006.01) |
| ***C23C 2/28*** | (2006.01) |

(Continued)

(52) U.S. Cl.

CPC ..... *C23C 2/12* (2013.01); *Y10T 428/256* (2013.01); *Y10T 428/2962* (2013.01); *C21D 8/0405* (2013.01); *C21D 2251/02* (2013.01); *B21D 35/007* (2013.01); *C23C 2/28* (2013.01);

(Continued)

(58) Field of Classification Search

CPC ..... B21D 22/002; B21D 35/007; C23C 2/12; C23C 22/50; C23C 28/32; C23C 28/3225; C23C 28/345; C23C 28/3455; C21D 8/0205; C21D 8/0405; C21D 2251/02

USPC ..... 72/41, 42, 46, 47, 342.1, 342.94, 72/342.96, 364

See application file for complete search history.

(56) References Cited

U.S. PATENT DOCUMENTS 3,522,108 A * 7/1970 Akanuma et al. ..... 148/245
4,460,630 A 7/1984 Nishino et al.

(Continued)

FOREIGN PATENT DOCUMENTS

EP 1439240 A1 7/2004
GB 2069001 A * 8/1981 ..... C22C 38/18

(Continued)

OTHER PUBLICATIONS

International Search Report dated Jun. 9, 2009 issued in corresponding PCT Application No. PCT/JP2009/058227.

(Continued)

*Primary Examiner* — Edward Tolan
(74) *Attorney, Agent, or Firm* — Kenyon & Kenyon LLP

(57) ABSTRACT

In a plated steel sheet having an aluminum-plating layer comprising at least Al formed on one side or both sides of the steel sheet, there is provided a plated steel sheet which, owing to the presence of a surface coating layer containing a compound having wurtzite crystal structure on the aluminum-plating layer, has excellent lubricity, prevents the plating thickness from becoming uneven during heating, and can improve formability and productivity in hot stamping, and a method of hot-stamping the plated steel sheet.

3 Claims, 5 Drawing Sheets

(51) Int. Cl.

| | |
|---|---|
| ***C23C 26/00*** | (2006.01) |
| ***C23C 28/00*** | (2006.01) |
| *C21D 8/04* | (2006.01) |

(52) U.S. Cl.

CPC ..... *C23C26/00* (2013.01); *C23C 28/321* (2013.01); *C23C 28/34* (2013.01); *C23C 28/345* (2013.01)

(56) References Cited

U.S. PATENT DOCUMENTS

| | | | | |
|---|---|---|---|---|
| 4,707,415 | A | 11/1987 | Ikeda et al. | |
| 5,525,431 | A * | 6/1996 | Kanamaru et al. | 428/623 |
| 5,766,783 | A | 6/1998 | Utsumi et al. | |
| 6,241,830 | B1 | 6/2001 | Shimakura et al. | |
| 6,254,980 | B1 | 7/2001 | Tadokoro et al. | |
| 6,291,761 | B1 | 9/2001 | Takada et al. | |
| 6,514,357 | B1 | 2/2003 | Tada et al. | |
| 6,564,604 | B2 * | 5/2003 | Kefferstein et al. | 72/47 |
| 7,338,718 | B2 | 3/2008 | Taira et al. | |
| 7,390,564 | B2 | 6/2008 | Yuasa et al. | |
| 7,416,774 | B2 | 8/2008 | Ueda et al. | |
| 7,642,693 | B2 | 1/2010 | Akiyama et al. | |
| 7,673,485 | B2 * | 3/2010 | Imai et al. | 72/47 |
| 7,811,670 | B2 | 10/2010 | Ragunathan et al. | |
| 7,832,242 | B2 * | 11/2010 | Brandsatter et al. | 72/47 |
| 8,025,980 | B2 | 9/2011 | Taira et al. | |
| 8,288,000 | B2 | 10/2012 | Ragunathan et al. | |
| 2005/0252262 | A1 * | 11/2005 | Imai et al. | 72/47 |

FOREIGN PATENT DOCUMENTS

| | | |
|---|---|---|
| JP | 63-153255 | 6/1988 |
| JP | 4-26778 | 1/1992 |
| JP | 7-268653 | 10/1995 |
| JP | 2000-38640 | 2/2000 |
| JP | 2003-129209 | 5/2003 |
| JP | 2003-261828 | 9/2003 |
| JP | 2004-211151 | 7/2004 |
| JP | 2004-270029 | 9/2004 |
| JP | 2004-346336 | 12/2004 |
| JP | 2006-213959 | 8/2006 |
| JP | 2007-260761 | 10/2007 |
| JP | 2007-327116 | 12/2007 |

OTHER PUBLICATIONS

European Search Report dated Apr. 7, 2011 issued in corresponding European Application No. 09 73 4858.

* cited by examiner (A) UNTREATED MATERIAL (B) ZnO COATED MATERIAL

PLATED STEEL SHEET AND METHOD OF HOT-STAMPING PLATED STEEL SHEET

This application is a divisional application of U.S. application Ser. No. 12/736,462, filed Oct. 7, 2010 now U.S. Pat. No. 8,453,482, which is a national stage application of International Application No. PCT/JP2009/058227, filed 21 Apr., 2009, which claims priority to Japanese Application No. 2008-111753, filed 22 Apr., 2008; each of which is incorporated by reference in its entirety.

FIELD OF THE INVENTION

This invention relates to an aluminum-plated steel sheet provided with an aluminum coating composed mainly of aluminum and excellent in lubricity during hot stamping and a method of hot-stamping the aluminum-plated steel sheet.

BACKGROUND ART

In recent years, calls have intensified for cutbacks on chemical fuel consumption in order to protect the environment and prevent global warming, and these demands have had various effects on the manufacturing industry. For example, even the automobile, an indispensable means of transport in daily life and activities, is no exception, and improved fuel efficiency and the like through body weight reduction and other means is being required. In the case of automobiles, however, mere realization of body weight reduction is not a viable option from the viewpoint of product quality, and appropriate safety must also be ensured.

The structure of an automobile is formed largely of steel, particularly steel sheet, and reducing the weight of the steel sheet is essential for vehicle body weight reduction. As just pointed out, however, mere reduction of steel sheet weight is not acceptable because the mechanical strength of the steel sheet must be ensured. Such requirements for steel sheet are not limited to the automaking industry but also apply similarly to various other manufacturing sectors. R&D has therefore been conducted with regard to steel sheet that; by enhancing the mechanical strength of the steel sheet, is capable of maintaining or increasing mechanical strength even when made thinner than the steel sheet used heretofore.

A steel material having high mechanical strength generally tends to decline in shape fixability during bending and other forming, so that the metalworking itself becomes difficult in the case of formation into a complicated shape. One means available for overcoming this formability problem is the so-called "hot stamping method (hot-pressing, high-temperature stamping, die-quenching)". In the hot stamping method, the steel material to be formed is once heated to a high temperature, whereafter the steel sheet softened by the heating is stamped and then cooled. Since the hot stamping method softens the steel material by once heating it to a high temperature, the material can be readily stamped, while, in addition, the mechanical strength of the material can be increased by the quenching effect of the cooling after the forming. The hot stamping method therefore makes it possible to obtain a formed article that simultaneously achieves good shape fixability and high mechanical strength.

However, when the hot stamping method is applied to a steel sheet, the heating to a high temperature of, for example, 800° C. or higher oxidizes iron and the like at the surface, thereby producing scale (oxide). A process for removing the scale (descaling) is therefore required after conducting the hot stamping, which lowers productivity. Moreover, in the case of a component or the like requiring corrosion resistance, it is necessary to corrosion-proof or metalclad the component surface after fabrication, which makes a surface cleansing step and a surface processing step necessary and also lowers productivity.

As an example of a method for minimizing such loss of productivity can be mentioned that of providing a coating on the steel sheet. Any of various materials, including organic materials and inorganic materials, are generally used for the coating on the steel sheet. Among them, steel sheet having a zinc-based coating that provides the steel sheet with a sacrificial corrosion protection effect is widely used for automotive steel sheet and the like, from the viewpoints of anticorrosion performance and steel sheet production technology. However, the heating temperature in hot stamping (700 to 1000° C.) is higher than, for example, the decomposition temperatures of organic materials and the boiling points of Zn-based and other metallic materials, so that the heating during hot stamping may sometimes evaporate the surface coating layer to cause marked degradation of the surface properties.

Therefore, as a steel sheet to be subjected to hot stamping involving high-temperature heating, it is preferable to use a steel sheet having an Al-based metal coating, which has a higher boiling point than an organic material coating or a Zn-based metal coating, that is, to use a so-called aluminum-plated steel sheet.

Provision of an Al-based metal coating prevents scale from adhering to the steel sheet surface and improves productivity by making a descaling or other such process unnecessary. Moreover, corrosion resistance after painting improves because the Al-based metal coating has a corrosion-proofing effect. Patent document 1 describes a method which performs hot stamping using an aluminum-plated steel sheet obtained by coating a steel having a predetermined steel composition with an Al-based metal coating.

However, when an Al-based metal coating is applied, and depending on the preheating conditions prior to stamping in the hot stamping process, it may happen that the Al coating first melts and is then changed to an Al—Fe alloy layer by Fe diffusion from the steel sheet, whereby Al—Fe compound comes to extend to the steel sheet surface with growth of the Al—Fe composite. This compound layer is hereafter called the alloy layer. As this alloy layer is extremely hard, processing scratches are formed by contact with the die during stamping.

The surface of the Al—Fe alloy layer is by nature relatively resistant to slipping and poor in lubricity. In addition, the Al—Fe alloy layer is relatively hard and susceptible to cracking, so that formability is liable to decrease owing to cracking, powdering and the like of the plating layer. Moreover, the quality of the stamped product is degraded by adhesion of Al—Fe to the die owing to, inter alia, sticking to the die of exfoliated Al—Fe alloy layer and of the strongly scored Al—Fe surface. This makes it necessary to remove the Al—Fe alloy powder adhering to the die during repair, which lowers productivity and increases cost.

In addition, the Al—Fe compound is low in reactivity with ordinary phosphate treatment, so that no film (phosphate film) is produced by the chemical conversion treatment, which is an electrocoating pretreatment. Painting adhesion is good even without formation of a chemical conversion treatment film and corrosion resistance after painting is also good so long as the coating weight of the Al plating is made adequate, but increasing the coating weight tends to aggravate the aforementioned die adherence. As was pointed out earlier, the adherence is sometimes due to attachment of exfoliated Al—Fe alloy layer and sometimes due to attachment owing to strong scoring of the Al—Fe surface. Although the latter problem is ameliorated by increasing the lubricity of the surface film, the beneficial effect with respect to the latter is relatively small. Coating weight reduction is the most effective for improvement in the former case. However, corrosion resistance decreases when the coating weight is reduced. The coating weight also has a major effect on local plating non-uniformity caused by the pinch effect, and unevenness of plating thickness is naturally less likely to occur at a lower coating weight. (The pinch effect will be discussed in detail later.)

In contrast, a steel sheet aimed at preventing processing scratches and the like is taught by Patent Document 2 listed below. Patent Document 2 teaches that a steel sheet of predetermined composition is provided with an Al-based metal coating and the Al-based metal coating is further formed thereon with an inorganic compound film containing at least one of Si, Zr, Ti and P, and an organic compound film, or a complex compound film of these. With the steel sheet formed with such a surface film or films, a surface film remains also during the stamping after heating, so that formation of processing scratches during stamping can be prevented. Moreover, the surface film(s) can serve as lubricant during stamping to enable formability improvement. In actuality, however, adequate lubricity cannot be realized, so that another lubricant or alternative means is required.

On the other hand, the heating to a high temperature prior to stamping melts the Al-based metal coating. Therefore, in the case where, for example, a furnace in which blanks stand vertically during the heating is used, the plating thickness becomes uneven because the molten aluminum plating runs under the force of gravity and the like.

Further, if, for example, resistance heating or induction heating is conducted, a higher temperature increase rate than in atmospheric heating or near-infrared ray (NIR) heating can be achieved, whereby productivity can be improved. However, when the steel sheet is heated by resistance heating or induction heating, the molten aluminum distributes unevenly at some portions owing to the pinch effect, so that the plating thickness becomes uneven. Such unevenness of plating thickness is undesirable from the aspect of product quality, degrades formability during the ensuing stamping, decreases productivity, and by extension is liable to lower corrosion resistance.

In other words, the fact that the aluminum plating melts poses a problem similar to that in galvanized steel sheet. Patent Document 3 teaches a method for overcoming surface degradation by evaporation of the surface zinc plating layer in hot stamping of galvanized steel sheet. Specifically, it teaches formation of a zinc oxide (ZnO) layer of high melting point on the surface of the zinc plating layer to serve as a barrier layer for preventing evaporation and runoff of the underlying zinc plating layer. However, the technique taught by Patent Document 3 assumes a zinc plating layer. Although it allows an Al content of up to 0.4%, it teaches that a lower Al concentration is preferable and is a technique not essentially premised on Al. The technological problem here is Zn evaporation and is therefore naturally a problem that cannot arise in the case of an Al plating of high boiling point.

PRIOR ART DOCUMENTS

Patent Documents

Patent Document 1: Japanese Patent Publication (A) No. 2000-38640

Patent Document 2: Japanese Patent Publication (A) No. 2004-211151

Patent Document 3: Japanese Patent Publication (A) No. 2003-129209

SUMMARY OF THE INVENTION

Problems to be Overcome by the Invention

As explained in the foregoing, an aluminum-plated steel sheet plated with Al of relatively high melting point is viewed as having potential for automotive steel sheet and other components requiring corrosion resistance, and various proposals regarding application of aluminum-plated steel sheet to hot stamping have been offered. However, the issues of the Al—Fe alloy layer in hot stamping have not been surmounted, so that in reality it remains impossible to apply aluminum-plated steel sheet to hot stamping of complicated shapes because, inter alia, suitable lubricity cannot be realized, stamp formability is poor, and the aluminum plating thickness becomes uneven owing to melting of the surface aluminum-plating layer. Recently, moreover, steel sheet shaped for automotive utilization is thereafter increasingly being painted, so that aluminum-plated steel sheet has also come to require chemical conversion treatability (paintability) after hot stamping and corrosion resistance after painting.

Thus, the present invention was accomplished in view of the foregoing problems, and the object of the present invention is to provide an aluminum-plated steel sheet excellent in post-painting corrosion resistance that has excellent lubricity, prevents the plating thickness from becoming uneven during heating, enhances formability and productivity in hot stamping, and improves chemical conversion treatability after hot-stamping, and a method of hot-stamping the aluminum-plated steel sheet.

Means for Overcoming the Problems

Through an intense study for overcoming the foregoing problems, the present inventors discovered that the presence of a surface coating layer containing at least a compound having wurtzite crystal structure on an aluminum-plating layer formed on one side or both sides of a steel sheet enables the aluminum-plating layer thickness to be evenly processed even when hot stamping is applied and that the lubricity due to the wurtzite coating on the Al—Fe alloy layer(s) is good, whereby they achieved the present invention. The gist of the invention is as set out below.

(1) An aluminum-plated steel sheet for hot stamping characterized in comprising an aluminum-plating layer formed on one side or both sides of a steel sheet, and a surface coating layer overlaid on the aluminum-plating layer(s) and containing at least a compound having wurtzite crystal structure.

(2) The aluminum-plated steel sheet for hot stamping set out in (1), characterized in that the aluminum-plating layer contains 3 to 15 mass % of Si.

(3) The aluminum-plated steel sheet set out in (1) or (2), characterized in that the compound having wurtzite crystal structure is ZnO.

(4) The aluminum-plated steel sheet set out in (3), characterized in that the ZnO content in the surface coating layer on one side of the steel sheet is 0.5 to 7 $g/m^2$ as Zn, the grain size of the ZnO is 50 to 300 nm, and the surface coating layer contains in addition to ZnO a resin component and/or a silane coupling agent at a weight ratio relative to ZnO of 5 to 30%.

(5) The aluminum-plated steel sheet set out in (3), characterized in that the ZnO content in the surface coating layer on one side of the steel sheet is 0.5 to 7 g/m$^2$ as Zn, the grain size of the ZnO is 50 to 300 nm, the surface coating layer contains in addition to ZnO a resin component and/or a silane coupling agent at a weight ratio relative to ZnO of 5 to 30%, and the steel sheet has holes in the surface coating layer owing to heating of the steel sheet to 850° C. to 1100° C.

(6) A method of hot-stamping aluminum-plated steel sheet, characterized in heating blanked aluminum-plated steel sheet comprising an aluminum-plating layer formed on one side or both sides of the steel sheet; and a surface coating layer containing ZnO overlaid on the aluminum-plating layer(s), and forming the heated aluminum-plated steel sheet by stamping.

(7) A method of hot-stamping aluminum-plated steel sheet, characterized in box-annealing coiled aluminum-plated steel sheet comprising an aluminum-plating layer formed on one side or both sides of the steel sheet, and a surface coating layer containing ZnO overlaid on the aluminum-plating layer(s), thereafter blanking and heating it, and stamping and forming the heated aluminum-plated steel sheet.

(8) The method of hot-stamping plated steel sheet set out in (6) or (7), characterized that the average temperature-increase rate of heating by resistance heating or induction heating during heating prior to stamping is 50° C. to 300° C./sec from a plated steel sheet temperature of 600° C. to a temperature 10° C. lower than the peak sheet temperature.

Effect of the Invention

As explained in the foregoing, the present invention provides a plated steel sheet for hot stamping that has excellent lubricity, prevents the plating thickness from becoming uneven even during rapid heating, prevents adherence to the die, and is also good in post-painting corrosion resistance, and a method of hot-stamping steel sheet, and enables productivity enhancement in said process.

MODES FOR CARRYING OUT THE INVENTION

Figure 1:
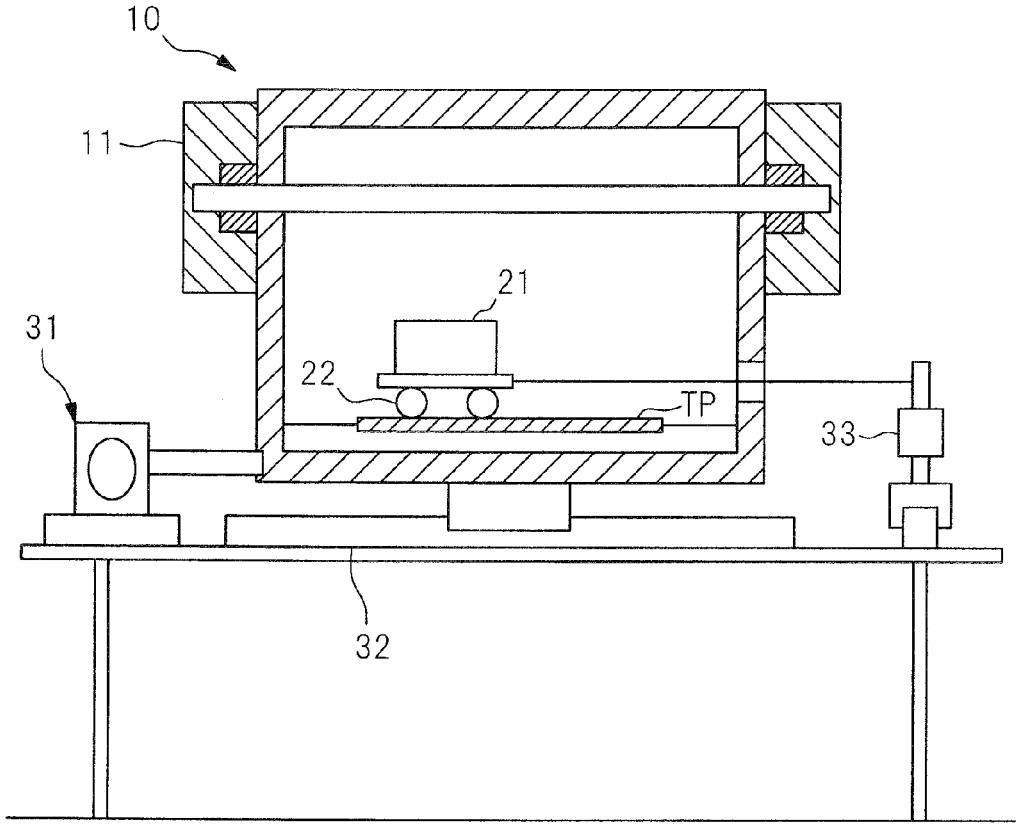
FIG. 1 is an explanatory diagram for explaining a hot lubricity evaluator according to an aluminum-plated steel sheet in accordance with an embodiment of the present invention.

Optimum modes of implementing the present invention are explained in detail below with reference to the attached drawings. Note that in the specification and drawings, constituent elements having substantially the same function and configuration are assigned like symbols to avoid redundant explanation.

<Plated Steel Sheet>

A plated steel sheet according to an embodiment of the present invention will be explained.

The plated steel sheet according to this embodiment has a layered structure of at least two layers on one side or each of both sides of the steel sheet. In other words, an aluminum-plating layer containing at least Al is formed on one side or both sides of the steel sheet and a surface coating layer containing at least a compound having wurtzite crystal structure is further overlaid on each aluminum-plating layer.

(Steel Sheet)

The steel sheet preferably used is, for example, a steel sheet formed to have high mechanical strength (meaning, for example, tensile strength, yield point, elongation, reduction, hardness, impact value, fatigue strength, creep strength, and other such properties related to mechanical deformation and fracture). An example of the composition of the steel sheet that realizes the high mechanical strength for enabling uses as an embodiment of the present invention is as follows.

The steel sheet contains at least one or more of, in mass %, C, 0.1 to 0.4%, Si: 0.01 to 0.6%, Mn: 0.5 to 3%, Ti: 0.01 to 0.1%, and B: 0.0001 to 0.1%, and the balance consists of Fe and unavoidable impurities.

The individual components added to the Fe will be explained.

C is added to secure the desired mechanical strength. When C content is less than 0.1%, adequate mechanical strength improvement cannot be achieved and the effect of C addition is weak. On the other hand, while a C content exceeding 0.4% enables the steel sheet to be further hardened, it increases the likelihood of fusion and cracking occurrence. Therefore, C is preferably added to a content, in mass %, of 0.1% to 0.4%.

Si is a strength enhancing element that improves mechanical strength and, like C, is added to secure the desired mechanical strength. When Si content is less than 0.01%, hardly any strength enhancing effect is manifested and adequate mechanical strength improvement cannot be achieved. On the other hand, Si is a readily oxidizable element. So when Si content exceeds 0.6%, wettabiity declines during hot-dip aluminum plating, making non-plating defects likely to occur. Therefore, Si is preferably added to a content, in mass %, of 0.01% to 0.6%.

Mn is a strengthening element that strengthens steel and also an element that enhances hardenability. In addition, Mn effectively prevents hot embrittlement by S, which is an unavoidable impurity. When Mn content is less than 0.5%, these effects are not obtained, and the aforesaid effects are exhibited at a content of 0.5% or greater. On the other hand, when Mn content exceeds 3%, strength is liable to decline because residual γ phase becomes excessive. Therefore, Mn is preferably added to a content, in mass %, of 0.5% to 3%.

Ti is a strength reinforcing element and also an element that improves the heat resistance of the aluminum-plating layer. When Ti content is less that 0.01%, no strength improving effect or oxidation resistance effect is realized, and these effects are exhibited at a content of 0.01% or greater. On the other hand, when too much Ti is added, the steel is liable to be softened by formation of, for example, carbides and nitrides. The probability of not being able to achieve the desired mechanical strength is particularly high when Ti content exceeds 0.1%. Therefore, Ti is preferably added to a content, in mass %, of 0.01% to 0.1%.

B has an effect of acting during hardening to improve strength. When B content is less than 0.0001%, this strength improving effect is low. On the other hand, when B content exceeds 0.1%, fatigue strength is liable to decrease owing to formation of inclusions and embrittlement. Therefore, B is preferably added to a content, in mass %, of 0.0001% to 0.1%.

Also of note is that this steel sheet can contain unavoidable impurities entrained in other manufacturing processes and the like.

The steel sheet formed of such composition can be hardened by heating using the hot stamping method or the like to have a mechanical strength of around 1500 MPa or greater. Although it is thus a steel sheet of high mechanical strength, it can be readily formed if processed by the hot stamping method because the stamping can be performed in a softened condition due to the heating. Moreover, the steel sheet can realize high mechanical strength and, by extension, can maintain or improve mechanical strength even if made thin for the purpose of weight reduction.

(Aluminum-Plating Layer)

As stated above, the aluminum-plating layer is formed on one side or both sides of the steel sheet. Although the aluminum-plating layer can be formed on the surface of the steel sheet by, for example, the hot-dip plating method, the method of forming the aluminum-plating layer of the present invention is not limited to this.

Moreover, any composition that contains Al can be applied in the present invention. Although the constituents other than Al are not particularly limited, Si can be positively added for the following reason.

When Si is added, the alloy layer formed during hot-dip plating metal coating can be controlled. When Si content is less than 3%, the Fe—Al alloy layer grows thick at the stage of applying the aluminum plating, which may promote plating layer cracking during processing to have an adverse effect on corrosion resistance. On the other hand, when Si content exceeds 15%, the workability and corrosion resistance of the plating layer might decline. Therefore, Si is preferably added to a content, in mass %, of 3% to 15%.

The aluminum-plating layer formed with such a composition can prevent steel sheet corrosion. Moreover, during processing of the steel sheet by the hot stamping method, it is possible to prevent formation of the scale (iron oxide) that occurs owing to oxidation of the surface of the steel sheet heated to a high temperature. Therefore, the aluminum-plating layer improves productivity by enabling omission of a scale removal process, surface cleansing process, surface treatment process, and the like. Moreover, since the boiling point and the like of the aluminum-plating layer are higher than those of an organic material coating or other metallic material (e.g., Zn-based) coating, working at a high temperature during formation by the hot stamping method is possible, formability in hot stamping is further enhanced, and the working becomes easy.

As set out in the foregoing, some of the Al contained in the aluminum-plating layer is alloyed with Fe of the steel sheet during hot-dip plating metal coating, heating by hot stamping, or the like. So the aluminum-plating layer is not necessarily a single layer of a specific composition and may sometimes locally include an alloyed layer (alloy layer).

(Surface Coating Layer)

The surface coating layer is overlaid on the surface of the aluminum-plating layer. The surface coating layer contains at least a compound having a wurtzite crystal structure. The surface coating layer containing the compound having a wurtzite crystal structure has such effects as to enhance the lubricity of the plated steel sheet and prevent uneven distribution of the aluminum-plating layer, thereby keeping its thickness uniform (these effects are discussed later). As compounds having a wurtzite crystal structure can be listed, for example, AlN, GaN, InN, TiN, TiN, MnS, MnSe, ZnO, ZnS, CdS, CdSe and the like. ZnO is particularly preferable. The reason for this is that while the compounds listed above have similar effects from the viewpoint of the lubricity and thickness uniformity of the molten Al plating, ZnO has the strongest effect from the viewpoint of improvement of reactivity to the chemical conversion treatment solution. In the following, explanation will be made taking as an example the case where ZnO is contained in the surface coating layer as this compound. It should be noted, however, that also when a compound other than ZnO is used as the compound having a wurtzite crystal structure, a surface coating layer of a constitution similar to that in the case of ZnO can be formed to realize similar effects.

The surface coating layer containing ZnO can be formed on the aluminum-plating layer by, for example, applying a coating composition containing ZnO particles and carrying out curing by baking/drying after the application. As ZnO application methods can be mentioned, for example, the method of mixing a sol containing ZnO and a predetermined organic binder and coating the mixture onto the aluminum-plating layer or the method of application by powder coating. As the prescribed organic binder can be mentioned, for example, polyurethane resin, polyester resin, acrylic resin, silane coupling agent, and the like. These are made water soluble so that they can dissolve in the sol containing the ZnO. The so-obtained coating solution is coated onto the surface of the aluminum-plated steel sheet.

The grain size of the fine particles of ZnO is not particularly limited but is preferably around 50 to 300 nm. Although the ZnO grain size is of two types, i.e., the grain size of the powder itself and the grain size in the sol after solation thereof, it is denoted as the size in the sol in the present invention. Since the fine powder in the sol generally experiences secondary agglomeration, the grain size in the sol is larger than the grain size of the powder itself. When the grain size of the powder itself is smaller than 50 nm, not only is mixing difficult but coarsening results because secondary agglomeration readily occurs. It is therefore difficult in actuality to make the particle diameter in the sol 50 nm or smaller. Moreover, when the grain size in the sol becomes greater than 300 nm, unevenness occurs because the particles tend to settle. When possible, a grain size of around 50 to 150 nm is preferably established.

The content of the binder component in the surface coating, including the resin component and/or silane coupling agent, is preferably around 5 to 30% by weight relative to ZnO. When lower than 5%, adequate binder effect cannot be obtained, in which case the coating tends to come off easily and, in addition, as explained later, lubricity may be markedly affected because holes do not occur after organic solvent evaporation. In order to obtain the binder effect consistently, the binder content is more preferably defined as 10% or greater by weight. On the other hand, a binder component content in excess of 30% is undesirable because odor emission during heating becomes pronounced.

Moreover, it was ascertained that the surface lubricity during hot stamping improves when the content of the binder component is in this range. This is thought to be because the evaporation of the binder organic solvent at the heating stage forms holes in the ZnO coating, whereby the ZnO, which has a lubrication effect, makes point contact with the die metal. To be more specific, owing to the ZnO being composed of fine particles, a coating made solely thereof would have a relatively smooth surface, in which case the resulting surface contact with the die would produce large sliding friction (the coefficient of friction would also become large). From this aspect, it might be thought that a larger ZnO grain size would be better, but ZnO has a large specific gravity of 5.7, so ZnO particles of large grain size would readily settle in the sol rather than reside stably therein. In other words, in order to ensure stability as a sol, the present invention calls for ZnO of small grain size and generates of holes in the ZnO coating so as to establish point contact during contact with the die. It was discovered that the aforesaid binder composition and content are effective for this hole formation.

It was ascertained that lubricity is high even in comparison with the inorganic compound coating containing at least one of Si, Zr, Ti or P, the organic compound coating or the complex compound coating thereof set out in Patent Document 2. As a result, further improvement of formability and productivity can be anticipated.

The ZnO coating weight of the surface coating layer on each side of the steel sheet preferably contains 0.5 to 7 $g/m^2$ calculated as Zn. When the ZnO content calculated as Zn is 0.5 $g/m^2$ or greater, it is possible to realize such effects as the lubricity improving effect (see FIG. 3) and the effect of preventing uneven distribution (effect of making the aluminum-plating layer thickness uniform). On the other hand, when the ZnO content as Zn exceeds 7 $g/m^2$, the aluminum-plating layer and surface coating layer become too thick, thereby degrading weldability and coating adhesion. Therefore, ZnO is preferably overlaid on the surface of the aluminum-plating layer at a content as Zn of 0.5 $g/m^2$ to 7 $g/m^2$ in the surface coating layer on each side of the steel sheet. Within this range, a content of about 1 to 4 $g/m^2$ is particularly preferable because it enables lubricity to be secured during hot stamping and further improves weldability and coating adhesion.

As the method of baking/drying after application, the hot-air furnace, induction furnace, near-infrared furnace methods and the like are, for example, suitable. And a method combining these is also acceptable. At this time, instead of post-coating baking/drying, it is possible depending on the type of binder used in coating application to perform curing treatment using, for example, ultraviolet rays, an electron beam or the like. As designated organic binders can be listed, for example, polyurethane, polyester, acrylic resin, silane coupling agent and the like. However, the method of forming the ZnO surface coating layer is not limited to these examples, and formation by any of various methods is possible.

When no binder is used, the adherence after coating on the aluminum plating is somewhat low and there is a risk of local peeling under rubbing with a strong force. However, after once being heated with passage through the hot stamping process, strong adherence is exhibited.

Such a surface coating layer containing ZnO can enhance the lubricity of the plated steel sheet. Of particular note is that this surface coating layer containing ZnO makes it possible to additionally further enhance lubricity beyond that of the inorganic compound coating containing at least one of Si, Zr, Ti or P, the organic compound coating or the complex compound coating thereof set out in Patent Document 2, and also to further improve formability and productivity.

Moreover, the melting point of ZnO is about 1975° C. and higher than that of the aluminum-plating layer and the like (the melting point of aluminum being about 660° C.). Therefore, when the plated steel sheet is processed by the hot-stamping method, for example, the surface coating layer containing ZnO does not melt even if the steel sheet is heated to, for example, 800° C. or higher. Therefore, even if the aluminum-plating layer should be melted by heating, the thickness of the molten aluminum-plating layer can be prevented from distributing unevenly because the aluminum-plating layer is maintained in a condition covered by the surface coating layer. Also of note is that uneven distribution of aluminum-plating layer thickness tends to occur, for example, in cases such as when heating is performed in a furnace that aligns blanks vertically or when heating is performed by resistance heating or induction heating. However, the surface coating layer can also prevent uneven distribution of aluminum-plating layer thickness when such types of heating are conducted and, as such, more efficiently enables uniformity of the aluminum-plating layer thickness than in the inorganic compound coating containing at least one of Si, Zr, Ti or P, the organic compound coating or the complex compound coating thereof set out in Patent Document 2. In addition, since the surface coating layer can prevent uneven distribution of aluminum-plating layer thickness, the aluminum-plating layer can be formed to greater thickness.

Thus, by offering such effects as improved lubricity and evenness of the aluminum-plating layer thickness, the surface coating layer improves formability during stamping and post-stamping corrosion resistance. Moreover, the fact that the thickness of the aluminum-plating layer can be made uniform enables heating of the plated steel sheet by resistance heating or induction heating, which enable heating at a higher rate of temperature increase. As a result, the time required in the heating step of the hot stamping method can be shortened to upgrade the productivity of the hot stamping method itself.

Moreover, as pointed out earlier, the surface coating layer is excellent in lubricity and minimizes adherence to the die. Even if the aluminum-plating layer should powder, the ZnO coating on the surface can prevent the powder (Al—Fe powder and the like) from sticking to die used in the downstream stamping process. Productivity can therefore be improved because there is no need to implement a process for removing Al—Fe powder adhered to the die. And the surface coating layer can play the role of a protective layer for preventing scratches and the like that might occur during stamping of the steel sheet and the aluminum-plating layer, and formability can also be enhanced. In addition, the surface coating layer does not impair such usability factors as spot weldability, coating adhesion and the like. Owing to the attachment of the chemical conversion treatment coating, the post-painting corrosion resistance is greatly improved and the plating coating weight can be reduced below that heretofore. As a result, productivity can be enhanced owing to uniform plating thickness and further reduced adherence with rapid heating.

<Processing by the Hot-Stamping Method>

The plated steel sheet of this embodiment was explained in the foregoing. While the so-formed plated steel sheet can be processed and formed by various methods, it is particularly useful in the case of conducting processing by the hot-stamping method, for example. Therefore, an explanation will now be made with regard to the case in which the plated steel sheet having the foregoing constitution is processed by the hot stamping method.

In the hot-stamping method according to this embodiment, the plated steel sheet is first heated to a high temperature to soften the steel sheet. The softened plated steel sheet is then formed by stamping, whereafter the formed plated steel sheet is cooled. Thus the steel sheet is once softened to enable the following stamping to be readily performed. Moreover, the steel sheet having the foregoing composition is hardened by the heating and cooling to realize a high mechanical strength of around 1500 MPa or greater.

While the plated steel sheet according to this embodiment is heated in the hot stamping processes, any of various heating methods can be adopted at this time, including ordinary heating methods using an electric furnace or radiant tube furnace, or other methods such as NIR, resistance heating, high-frequency induction heating or the like. The plated steel sheet can be blanked and heated using these heating means, and particularly in the case of using resistance heating or high-frequency heating, a problem of uneven plating thickness arises owing to the pinch effect, so that especially when a degree of thickness is desired, alloying is performed beforehand by heating the coil in a box annealing furnace, thereby enabling total prevention of plating thickness unevenness. As the melting point is increased to about 1150° C. by the alloying, the problem of the pinch effect acting on molten steel is eliminated. In this case, the box-annealed coil is blanked for supply to the hot stamping.

When the aluminum-plated steel sheet is heated to above its melting point, it melts and simultaneously changes to an Al—Fe, Al—Fe—Si alloy layer owing to interdiffusion with Fe. The melting point of the Al—Fe, Al—Fe—Si alloy layer is high and if the alloying extends to the surface, the pinch effect no longer acts. There are multiple Al—Fe, Al—Fe—Si alloys that change to alloys of high Fe concentration during high-temperature heating or prolonged heating. In the preferred surface condition of the final product, the condition is one in which the alloying has reached the surface and in which the Fe concentration of the alloy layer is not high. If unalloyed Al remains, only this region rapidly corrodes, which is undesirable for post-painting corrosion resistance because vulnerability to paint blistering becomes very high. If, to the contrary, the Fe concentration of the alloy layer becomes too high, the corrosion resistance of the alloy layer itself declines, so that the post-painting corrosion resistance is marked by ready occurrence of paint blistering. This is because the corrosion resistance of the alloy layer depends on the Al concentration in the alloy layer. An alloying condition therefore exists that is preferable for post-painting corrosion resistance and the alloying condition is determined by the coating weight of the plating and the heating condition.

Particularly when resistance heating or high-frequency heating is used, the average temperature-increase rate in high-temperature heating from 600° C. to a temperature 10° C. lower than the peak sheet temperature can be set at 50° C. to 300° C./sec. While the average rate of temperature increase by the heating affects the productivity in the stamping of the plated steel sheet, the average temperature-increase rate is, for example, generally set at about 5° C./sec in high-temperature heating in the case of atmospheric heating and about 10 to 50° C./sec in the case of near-infrared heating.

The plated steel sheet according to this embodiment enables improved productivity because, as explained in the foregoing, a high average temperature-increase rate can be realized. In addition, the average temperature-increase rate for example affects the constitution and thickness of the alloy layer and, as such, is an important factor controlling plated steel sheet quality. In the case of the plated steel sheet according this embodiment, the temperature-increase rate can be raised to 300° C./sec, thereby making it possible to control product quality over a broad range. As the peak temperature, generally there is usually adopted one of about 900 to 950° C. in view of the fact that the principle of hot stamping requires heating in the austenite region. Although the peak temperature is not particularly limited in the present embodiment, one of 850° C. or lower is not so desirable because it may become impossible to obtain adequate quenching hardness. Moreover, the aluminum-plating layer needs to change to an Al—Fe alloy layer, so that 850° C. or lower is also undesirable from this aspect. If the alloying should advance too far at a temperature exceeding 1000° C., the Fe concentration of the Al—Fe alloy layer might increase to cause degradation of the post-painting corrosion resistance. Although nothing absolute can be said in this regard because the temperature-increase rate and the coating weight of the aluminum plating are also factors, heating to 1100° C. or higher is undesirable also from the economic viewpoint.

Moreover, as regards the plated steel sheet according to this embodiment, it is possible, for example, to use a heating method by resistance heating or induction heating as the heating method for achieving the aforesaid high temperature-increase rate. Generally when aluminum-plated steel sheet is heated to a high temperature of, for example, 800° C. or higher, the aluminum-plating layer melts and the resistance heating or induction heating passes electric current through not only the steel sheet but also the aluminum-plating layer. The current passing through the molten, high-temperature aluminum-plating layer may produce the so-called "pinch effect." As is clear from Biot-Savarti's rule, Fleming's left hand rule and other electromagnetic laws, a force of attraction acts between conductors passing electric current in the same direction. The phenomenon of the current conducting paths being constricted by this force is called the "pinch effect." When the conductor passing the current is a fluid like the molten aluminum-plating layer, the attractive force constricts the fluid at the site of the conducting path constriction. As a result, the thickness of the aluminum-plating layer increases at the constriction site and becomes thinner at other regions, thereby losing its uniformity. Use of resistance heating, induction heating or other heating methods involving passage of electric current for high-temperature heating of plated steel sheet has therefore been difficult from viewpoint of maintaining product quality. However, in the case of the plated steel sheet according to this embodiment, the presence of the surface coating layer containing ZnO makes it possible to keep the thickness of the aluminum-plating layer uniform. Therefore, the plated steel sheet according to this embodiment reduces the effect on the aluminum-plating layer thickness attributable to the pinch effect and the like, thereby enabling heating by resistance heating or induction heating and making it possible to increase the temperature-increase rate.

As explained in the foregoing, the plated steel sheet according to this embodiment is heated to a high temperature of 800° C. or higher by resistance heating or induction heating and then formed by stamping using a die or the like. At this time, the surface coating layer containing ZnO, which is not melted, plays the role of a buffer and the lubricating action possessed by the hot ZnO itself protects the aluminum-plating layer and steel sheet from the die, thereby preventing scratching by the die. In reverse, it is possible, for example, to prevent adherence of powder (Al powder and the like) to the die owing to the occurrence of cracks or by powdered aluminum-plating layer, thereby enabling improved formability and productivity.

<Example of the Effects of the Plated Steel Sheet and Hot Stamping Method>

The plated steel sheet and method of hot-stamping plated steel sheet according this embodiment were explained in the foregoing. The plated steel sheet according to this embodiment has a surface coating layer containing at least a compound having a wurtzite crystal structure, specifically ZnO, whereby, as set out above, it is possible, for example, to realize high lubricity and make the thickness of the aluminum-plating layer uniform.

As a result, the plated steel sheet according to this embodiment can be used in the hot-stamping method utilizing induction heating or resistance heating and can enable realization of heating at a high temperature-increase rate, thereby making it possible to improve productivity and formability. Moreover, the present embodiment exploits the properties of the wurtzite compound, so the amounts of the dispersant and other constituents for dispersing the binder and fine ZnO should be suitably determined.

Incidentally, one conceivable reason why the surface coating layer containing the compound having such a wurtzite crystal structure, specifically ZnO, enables high lubricity might be, for example, that the compound having the wurtzite crystal structure is composed of grains that are closer to spherical than those of the other substances and have small frictional resistance with respect to the die used in the stamping process. Moreover, one conceivable reason why it enables the plating thickness to be made uniform as mentioned above might be, for example, that the compound having the wurtzite crystal structure has a higher melting point (about 1975° C. for ZnO, for example) than the other compounds, such as the organic compounds, and does not melt even under the high temperature during hot stamping (about 800° C. or higher).

In other words, as set out earlier, the surface coating layer in accordance with this embodiment is higher in melting point than the aluminum-plating layer and does not melt even at the peak temperature by the heating. Therefore, the aluminum-plating layer is retained between the unmelted surface coating layer and the steel sheet. As a result, it is thought that even if the aluminum-plating layer melts, uneven distribution of the aluminum-plating layer will be prevented by the strength and tension of the surface coating layer. In addition, the surface coating layer containing at least a compound having a wurtzite crystal structure is extremely effective for plating thickness uniformity compared with surface coating layers composed of high-melting-point inorganic compounds with a crystal structure other than wurtzite. Therefore, aside from the aforesaid melting point, there may conceivably exist other factors, such as strength, tension and the like, that are peculiar to the wurtzite crystal structure and enable uniformization of the plating thickness.

It should be noted that the reasons and factors mentioned here are presumed to be only some of the causes for manifestation of the results and, needless to say, the present invention is not limited thereby and the existence of other factors is conceivable.

It not clear at this point why the ZnO enables adherence of the chemical conversion treatment film, but it is supposed that since the chemical conversion treatment reaction progresses with an acid-etch reaction toward the substrate acting as a trigger, reaction with the Al—Fe surface does not readily occur because the surface is very inert to acid. By imparting the coating containing ZnO and heating it to 800° C. or higher, the constitution of the oxide coating changes, i.e., the Al oxide becomes Al—Fe oxide, and this is believed to change the reactivity with surface acid.

In addition, the surface coating layer exhibits its effect of preventing non-uniformity of molten aluminum-plating layer thickness not only during the aforesaid heating by resistance heating or induction heating but also operates, for example, when the plated steel sheet is heated, processed or the like in an inclined condition in a furnace. In other words, ordinarily when a plated steel sheet is heated while standing at a slant, the molten aluminum-plating layer runs down under the force of gravity and the like to cause uneven distribution, but this uneven distribution can be prevented by the plated steel sheet according this embodiment.

EXAMPLE 1

The present invention will next be explained in more detail by examples. A cold-rolled steel sheet of the composition shown in Table 1 (1.4 mm thickness) was Al-plated by the Sendzimir method. The annealing temperature at this time was about 800° C., and the Al plating bath contained Si: 9% and additionally contained Fe eluted from the steel strip. The coating weight after plating was adjusted to 160 g/m$^2$ on both sides by the gas wiping method, and after cooling, a solution shown in Table 2 was applied with a roll coater and baked at about 80° C. The chemical solutions shown in Table 2 used nanotek slurry from C.I. Kasei Co., Ltd. The grain size of the compounds in the solutions was approximately 70 nm.

It should be noted that although the metal content differs among the compounds in Table 2, the nonvolatile matter contents in the chemical solutions are the same and the amounts of the applied solutions were made substantially the same. The reason for the different contents is that the ratio of the compound molecular weight to the metal content is different for every compound. The characteristics of the test specimens prepared in this manner were evaluated by the following methods.

Hot Lubricity

Hot lubricity was evaluated using the apparatus shown in FIG. 1. A 150×200 mm steel sheet was heated to 900° C., steel spheres were then pressed onto it from above at 700° C., the pressing load and the drawing load were measured, and the coefficient of dynamic friction was defined as drawing load/pressing load.

Al Plating Film Thickness Uniformity

Figure 2:
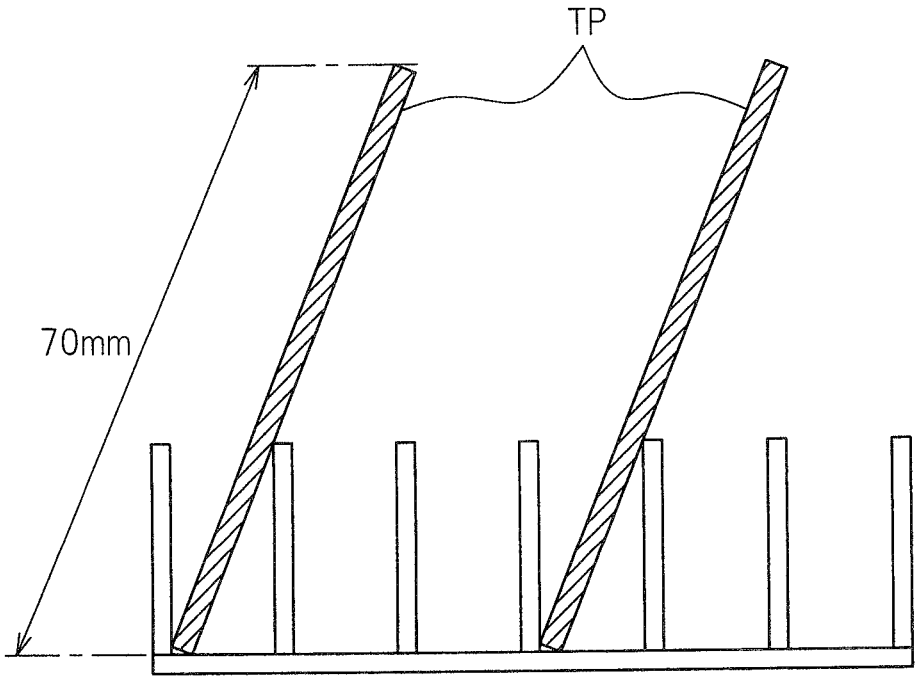
FIG. 2 is an explanatory diagram for explaining aluminum plating film thickness evaluation according to an aluminum-plated steel sheet in accordance with an embodiment of the present invention.

Two methods were used. (Condition 1) 70×150 mm test pieces were placed in a furnace with their 70 mm sides aligned vertically as shown in FIG. 2 and heated to 900° C. The thickness difference of the sheet bottom sides between before and after heating was measured.

(Condition 2) In the other method, an 80×400 mm test piece was gripped by electrodes at its opposite longitudinal ends and resistance heated, whereafter the thickness difference at the middle between before and after heating was measured.

Spot Weldability

A test piece was placed in a furnace, heated for 6 min in the furnace at 900° C., and upon removal was immediately clamped by a stainless steel die and rapidly cooled. The cooling rate at this time was about 150° C./sec. It was next sheared to 30×50 mm and the suitable spot welding current range (upper limit current−lower limit current) was measured. The measurement conditions were as set out below. The lower limit current was defined as the current value when the nugget diameter became $4\sqrt{t}$ (4.4 mm) and the upper limit current was defined as the spatter-producing current.

Electrode: chromium-copper, DR (6 mm ϕ tip of 40 R)

Applied pressure: 400 kgf

Weld time: 12 cycles (60 Hz)

Post-Painting Corrosion Resistance

A test piece was placed in a furnace, heated for 6 min in the furnace at 900° C., and upon removal was immediately clamped by a stainless steel die and rapidly cooled. The cooling rate at this time was about 150° C./sec. It was next sheared to 70×150 mm, subjected to chemical conversion treatment using a chemical conversion treatment solution (PB-SX35T) from Nihon Parkerizing Co., Ltd., painted with an electrodeposition coating (Powernics 110) from Nippon Paint Co., Ltd. to a target of 20 μm, and baked at 170° C.

Post-painting corrosion resistance evaluation was done by the method prescribed by JASO M609 established by the Society of Automotive Engineers of Japan. A cutter was used to make a crosscut in the paint film, and the width (maximum value on one side) of the paint film blister from the crosscut after 180 cycles (60 days) of corrosion testing was measured.

TABLE 1

| Steel composition of test specimen (mass %) | | | | | | | |
|---|---|---|---|---|---|---|---|
| C | Si | Mn | P | S | Ti | B | Al |
| 0.21 | 0.12 | 1.21 | 0.02 | 0.012 | 0.02 | 0.003 | 0.04 |

TABLE 2

| Coating treatment solutions | | | | | | |
|---|---|---|---|---|---|---|
| Symbol | A | B | C | D | E | F |
| Compound | $Al_2O_3$ | ZnO | $TiO_2$ | $SiO_2$ | $SnO_2$ | CoO |
| Coating weight (*1) | 2 g/m$^2$ | 3 g/m$^2$ | 2 g/m$^2$ | 2 g/m$^2$ | 3 g/m$^2$ | 3 g/m$^2$ |
| Crystal structure | Co-rundum | Wurtz-ite | Rutile | Amor-phous | Rutile | NaCl |

(*1): All expressed by metal content (Al for $Al_2O_3$, Zn for ZnO)
Nonvolatile matter contents all 15 mass %

TABLE 3

| Evaluation results for individual matrials | | | | | | | | |
|---|---|---|---|---|---|---|---|---|
| Symbol | | A | B | C | D | E | F | G |
| Compound | | $Al_2O_3$ | ZnO | $TiO_2$ | $SiO_2$ | $SnO_2$ | CoO | None |
| Hot lubricity | | 0.92 | 0.61 | 0.88 | 0.96 | 1.01 | 0.94 | 0.95 |
| Plating layer thickness uniformity | Condition 1 | 0.25 mm | 0 mm | 0.15 mm | 0.23 mm | 0.25 mm | 0.22 mm | 0.35 mm |
| | Condition 2 | 0.5 mm | 0 mm | 0.42 mm | 0.65 mm | 0.53 mm | 0.5 mm | 0.77 mm |
| Spot weldability | | 1.9 kA | 2 kA | 2 kA | 2.1 kA | 2 kA | 2 kA | 2.1 kA |
| Post-coating corrosion resistance | | 8 mm | 2 mm | 7 mm | 9 mm | 12 mm | 10 mm | 6 mm |

The evaluation results are summarized in Table 3. Hot lubricity is indicated as coefficient of dynamic friction, plating layer thickness uniformity as difference in sheet thickness between before and after heating, spot weldability as suitable current range, and post-painting corrosion resistance as blister width value. The values in the case of no treatment are shown in the far-right column. It can be seen that the forming of a coating containing the wurtzite compound ZnO improved hot lubricity, plating thickness uniformity and post-painting corrosion resistance, while spot weldability was about the same. The compounds having other crystal structures exhibited no marked improving effect for any of the characteristics.

Figure 4:
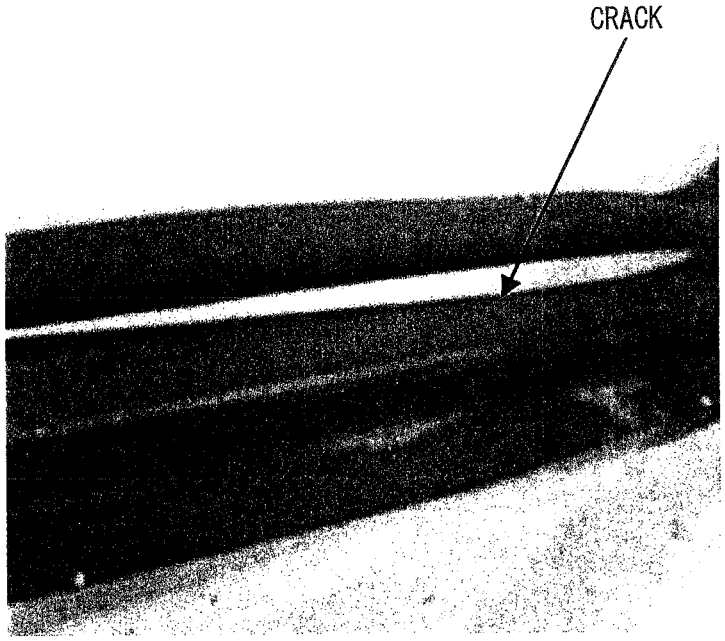
FIG. 4 is an explanatory diagram for explaining occurrence of cracking depending on presence or absence of a ZnO layer in an aluminum-plated steel sheet in accordance with an embodiment of the present invention.
Figure 4:
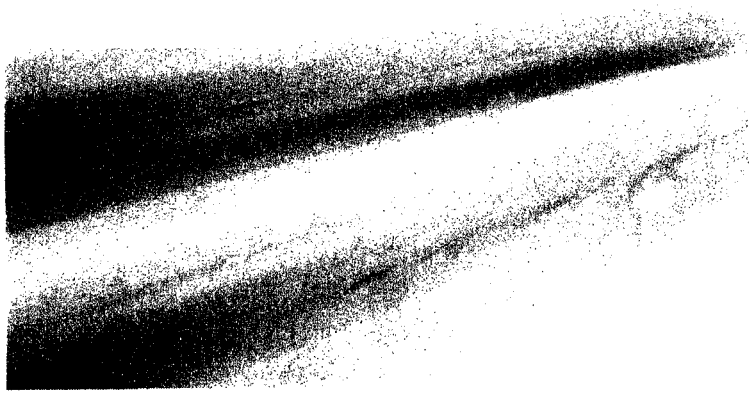

An actual hot stamping test was conducted to verify the hot lubricity effect of ZnO. When a test piece coated with ZnO at 3 g/m$^2$ and a test piece not coated with ZnO were formed into the shape of door impact beams, the test piece not given a ZnO coating experienced cracking while the test piece coated with ZnO experienced no cracking, thus confirming the lubricity improving effect. The state of the cracking at this time is shown in FIG. 4.

Figure 3:
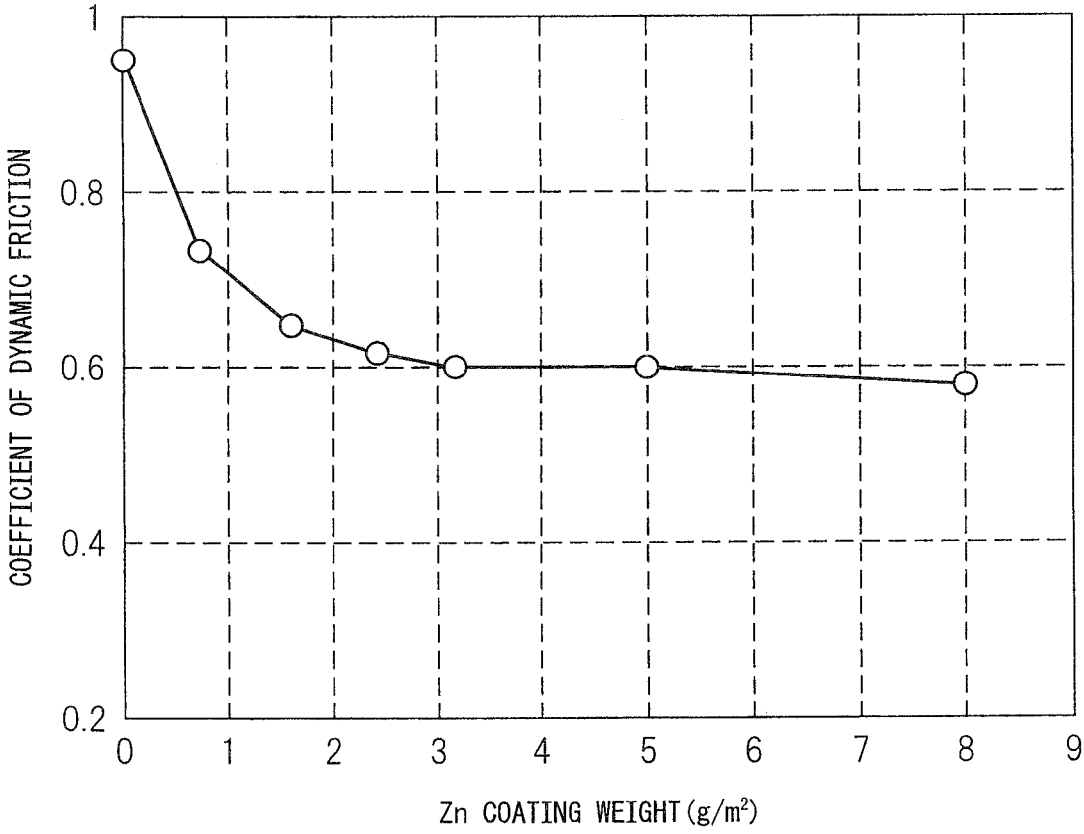
FIG. 3 is an explanatory diagram for explaining hot lubricity according to an aluminum-plated steel sheet in accordance with an embodiment of the present invention.

Next, in order to ascertain the required amount of ZnO coating, hot lubricity was evaluated at varied coating weights. The chemical solutions were those set out above. The results are shown in FIG. 3. Hot lubricity improved in the region of Zn content from roughly 0.5 g/m$^2$ upward, more preferably 1 g/m$^2$ upward.

Figure 5:
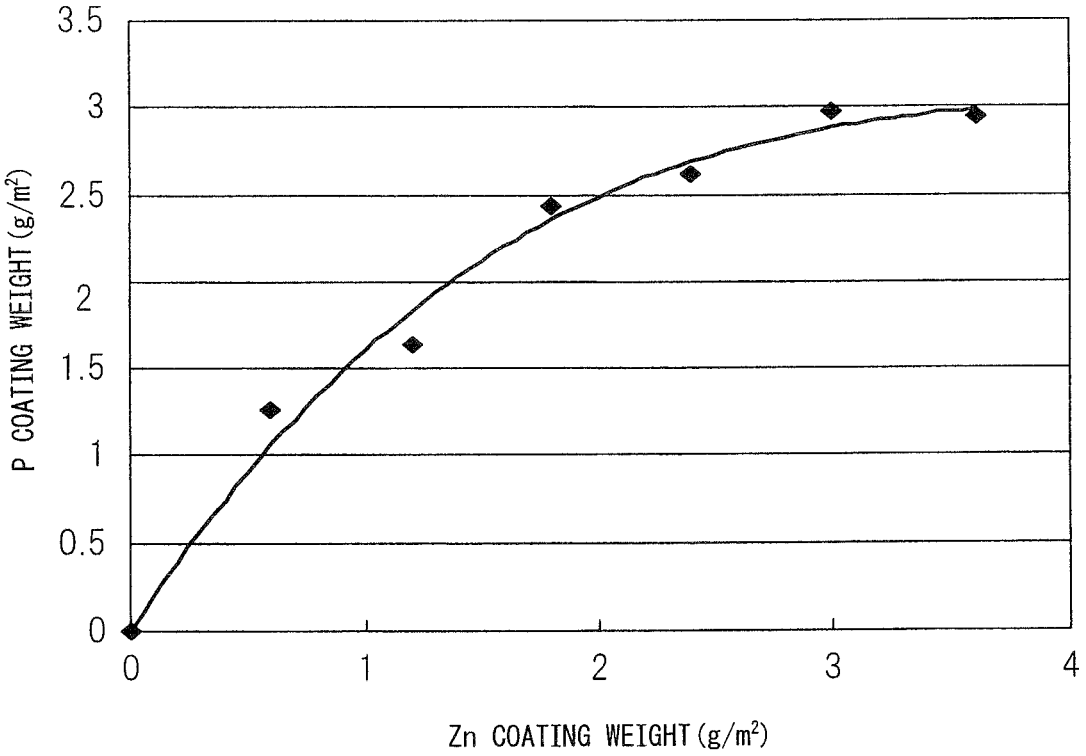
FIG. 5 is an explanatory diagram showing the relationship between ZnO content (ZnO coating weight) and a chemical conversion coating (P coating weight) in an aluminum-plated steel sheet in accordance with an embodiment of the present invention.

On the other hand, measurement was also made with respect to chemical conversion treatment film coating weight. The results are shown in FIG. 5. P coating weight increased with increasing Zn coating weight. P coating weight tended to saturate from Zn of 3 g/m$^2$ upward. Post-painting corrosion resistance at this time was also evaluated, and it was found that post-painting corrosion resistance improved substantially in proportion to chemical conversion treatment film coating weight.

From this fact, it is considered that the chemical conversion treatability of the aluminum-plated steel sheet was probably improved by the application of the ZnO coating. Although the particulars of the mechanism are unknown, it is thought that some kind of reaction possibly occurs between the ZnO and Al in the plating under the high-temperature environment of the hot stamping, thereby forming an Al—Zn-based complex coating that inhibits generation of an $Al_2O_3$ coating.

Moreover, in order to ascertain the effect of the compound crystal structure, tests were also carried out with respect to other wurtzite compounds. A small amount of urethane resin was mixed with fine powders of AlN and Tin (grain size of about 0.2 μl) and thoroughly mixed to prepare coating solutions. The obtained coating solutions were applied onto aluminum-plated steel sheets each to a target of 2 g/m$^2$ in terms of Al and Ti, and baked at 80° C. Upon evaluation, the hot lubricities of the specimens were found to be 0.65 and 0.68, respectively. From a comparison with the examples using $Al_2O_3$ and $TiO_2$ in Table 3, it is considered that compounds of wurtzite crystal structure are superior.

EXAMPLE 2

To a ZnO fine-particle suspension (nanotek slurry from C.I. Kasei Co., Ltd.) was added water-soluble acrylic resin at a weight ratio of 5 to 20% relative to Zn and silane coupling agent at a weight ratio of 10 to 20%, whereafter the obtained solution was applied and evaluated in the same manner as set out in the foregoing. In addition, a lapping test was conducted to evaluate the peeling property of the coating. The conditions at this time were load of 1500 g and number of repetitions 10, the coating weights were measured before and after testing, and the ratio of the exfoliated amount to the initial amount was calculated. The results of the evaluation at this time are summarized in Table 4.

TABLE 4

| Evaluation results for individual matrials | | | | | | | |
|---|---|---|---|---|---|---|---|
| Symbol | H | I | J | K | L | M | N |
| ZnO content(g/m$^2$) | 1.0 | 1.0 | 1.0 | 1.0 | 3.0 | 2.0 | 2.0 |
| Binder type (*) | None | A | A | A | A | B | B |
| Binder content (%) | — | 5 | 10 | 20 | 10 | 10 | 20 |
| Coat peeling (%) | 25 | 2 | 1 | ≤1 | 1 | 2 | 1 |
| Hot lubricity | 0.6 | 0.55 | 0.53 | 0.55 | 0.50 | 0.52 | 0.53 |
| Plating layer thickness uniformity Condition 1 | 0 mm | 0 mm | 0 mm | 0 mm | 0 mm | 0 mm | 0 mm |
| Plating layer thickness uniformity Condition 2 | 0 mm | 0 mm | 0 mm | 0 mm | 0 mm | 0 mm | 0 mm |
| Spot weldability | 2 kA | 2 kA | 2.1 kA | 2 kA | 2 kA | 2.1 kA | 2 kA |
| Post-coating corrosion resistance | 2.5 mm | 2.5 mm | 2.5 mm | 2.5 mm | 2 mm | 2 mm | 2 mm |

(*) Binder
A: Acrylic resin (polyacrylic acid)
B: Silane coupling agent (25% Si calculated as $SiO_2$, Shin-Etsu Silicone When the binder component was absent, the coating peeled when strongly rubbed. However, peeling ceased once a heat history equivalent to hot stamping was imparted. Although it is not known whether peeling of this degree would be a problem in practical application, no peeling is of course preferable. Addition of a binder component inhibited peeling and further improved hot lubricity. And it was determined that other characteristics were not affected.

Although preferred modes of carrying out the present invention where explained in detail with reference to the attached drawings in the foregoing, it goes without saying that the present invention is not limited to these examples. Moreover, while explanation was made taking steel sheet as an example, it goes without saying that application is possible to variously shaped steel materials, including bar steel, wire, steel pipe and the like, without limitation to those of sheet shape. A person having ordinary knowledge in the field of technology to which the present invention belongs will obviously be able to conceive various changes and modifications within the scope of the technical idea set out in the claims, and it is understood that all of these naturally fall within the technical scope of the present invention.

EXAMPLE 3

In order to determine the effect of ZnO grain size, commercially available ZnO sols of various grain sizes were used, with 5% of binder A of the second example added thereto. The solution was thoroughly mixed and then left to stand at 40° C. for 24 hr, and whether or not ZnO sedimentation occurred was judged visually. The judgment criteria were as follows.

TABLE 5

| Results of ZnO sedimentation property evaluation | | | | | | | |
|---|---|---|---|---|---|---|---|
| Symbol | O | P | Q | R | S | T | U |
| Grain size(μm) | 0.05 | 0.1 | 0.3 | 0.5 | 1 | 3 | 5 |
| Sedimentation property | ○ | ○ | ○ | Δ | x | x | x |

○: No sedimentation
Δ: Slight sedimentation
x: Sedimentation

ZnO sedimentation was observed when the ZnO grain size was large. (Some sedimentation was observed even at a ZnO grain size of 0.5 μm.) A powder of 0.01 μm grainsize was also tested, but secondary agglomeration occurred in the sol, so that the grain size in the sol became around 0.05 μm. It was therefore impossible to obtain a solution whose grain size in the sol was 0.05 μm or less.

INDUSTRIAL APPLICABILITY

In the hot stamping of aluminum-plated steel sheet, the present invention enables processing while ensuring good lubricity and plating uniformity, thereby enabling more complex stamping than in the past. In addition, labor can be saved in the maintenance and repair of the hot stamping, and productivity is also improved. Since the chemical conversion treatability of the processed product after hot stamping is good, improvement of the paint finish and corrosion resistance of the final product is also observed. Owing to these facts, it is believed that the present invention will expand the range of application of hot stamping to aluminum-plated steel and enhance the applicability of aluminum-plated steels to the automobiles and industrial equipment that are the final applications.

EXPLANATION OF THE SYMBOLS

10 Furnace
11 Element heater
21 Load
22. Steel sphere
31 Furnace body drive unit
32 Ball way
33 Load cell
TP Test piece

The invention claimed is:

1. A method of hot-stamping a plated steel sheet comprising:

heating a blanked plated steel sheet comprising an aluminum-plating layer formed on one side or both sides of the steel sheet, and a surface coating layer containing ZnO overlaid on the aluminum-plating layer(s), and forming the heated plated steel sheet by stamping, wherein the surface coating layer contains at least a ZnO having a wurtzite crystal structure, and the ZnO content in the surface coating layer on each side of the steel sheet, calculated as Zn, is 0.5 to 7 g/m$^2$; and wherein the aluminum-plating layer(s) contains 3 to 15 mass % of Si.

2. A method of hot stamping a plated steel sheet comprising:

box-annealing a coiled plated steel sheet comprising an aluminum-plating layer formed on one side or both sides of the steel sheet, and a surface coating layer containing ZnO overlaid on the aluminum-plating layer(s), thereafter blanking and heating it, and stamping and forming the heated plated steel sheet, wherein the surface coating layer contains at least a ZnO having a wurtzite crystal structure, and the ZnO content in the surface coating layer on each side of the steel sheet, calculated as Zn, is 0.5 to 7 $g/m^2$; and wherein the aluminum-plating layer(s) contains 3 to 15 mass % of Si.

3. The method of hot-stamping a plated steel sheet according to claim 1 or 2, wherein an average temperature-increase rate of heating by resistance heating or induction heating during heating prior to stamping is 50° C. to 300° C./sec from a plated steel sheet temperature of 600° C. to a temperature of 10° C. lower than a peak sheet temperature.

* * * * *

UNITED STATES PATENT AND TRADEMARK OFFICE

CERTIFICATE OF CORRECTION

PATENT NO. : 9,074,277 B2
APPLICATION NO. : 13/309143
DATED : July 7, 2015
INVENTOR(S) : Jun Maki et al.

It is certified that error appears in the above-identified patent and that said Letters Patent is hereby corrected as shown below:

In the Specification

Column 1, line 40, change “steel sheet that; by” to -- “steel sheet that, by” --; and Column 8, line 2, change “TiN” to -- “TlN” --; and In the Claims Column 17, line 66, change “0.01μm grainsize” to -- “0.01μm grain size” --.

Signed and Sealed this
Twelfth Day of April, 2016

Michelle K. Lee

Michelle K. Lee
*Director of the United States Patent and Trademark Office*